US008485699B2

(12) United States Patent
Reda, Jr.

(10) Patent No.: US 8,485,699 B2
(45) Date of Patent: Jul. 16, 2013

(54) SELF-RIGHTING LIGHT FIXTURE

(75) Inventor: Ronald F. Reda, Jr., Chicago, IL (US)

(73) Assignee: WL Patent Holdings, LLC, Mundelein, IL (US)

( * ) Notice: Subject to any disclaimer, the term of this patent is extended or adjusted under 35 U.S.C. 154(b) by 146 days.

(21) Appl. No.: 11/274,689

(22) Filed: Nov. 15, 2005

(65) Prior Publication Data

US 2007/0109797 A1 May 17, 2007

(51) Int. Cl.
*F21V 21/20* (2006.01)

(52) U.S. Cl.
USPC ..... 362/401; 362/373; 362/410; 362/414; 362/441; 40/608

(58) Field of Classification Search
USPC ..... 362/97, 196, 373, 427, 812, 253, 362/401, 410, 414, 441; 40/608; 441/16, 441/17, 18
See application file for complete search history.

(56) References Cited

U.S. PATENT DOCUMENTS 524,894 A * 8/1894 Forsberg ..... 482/85
1,228,615 A * 6/1917 Stafford ..... 40/608
5,001,617 A * 3/1991 Chan ..... 362/401
5,134,555 A 7/1992 Messana
5,304,035 A * 4/1994 Carter ..... 416/63
5,381,325 A 1/1995 Messana
5,392,801 A * 2/1995 Hannoosh et al. ..... 135/65
5,479,322 A * 12/1995 Kacheria ..... 362/581
5,490,051 A 2/1996 Messana
5,582,196 A * 12/1996 Hae et al. ..... 135/65
5,590,956 A 1/1997 Messana et al.
6,352,358 B1 * 3/2002 Lieberman et al. ..... 362/294
6,808,291 B1 * 10/2004 Aylward et al. ..... 362/205

* cited by examiner

*Primary Examiner* — Mary McManmon
(74) *Attorney, Agent, or Firm* — Momkus McCluskey, LLC; Jefferson Perkins

(57) ABSTRACT

A self-positioning light fixture having an elongated body with a bottom self-righting segment. The elongated body comprises a pair of elongated body portions mateable along a vertical parting plane with components of the light fixture, such as the shock mount for the lamp assembly, an air circulating fan, and counterweights, being retained and supported within the body portions as an incident to assembly and securement of the body portions. The self-righting segment and counterweights are designed for optimally uprighting the fixture from tipped positions with minimum counterweighting and without excessive force or rocking movement of the fixture. Further features of the light fixture include air vent openings in the body that prevent or minimize entry of rain water and contaminants, an easily accessible gripping handle for facilitating movement of the light fixture, and a reflector shield adapted for easy selective positioning about the lamp assembly for the desired light direction.

21 Claims, 6 Drawing Sheets

SELF-RIGHTING LIGHT FIXTURE

FIELD OF THE INVENTION

The present invention relates to self-positioning or self-righting lamp fixtures of the type which return to their upright position when accidentally tipped or tilted away from such position.

BACKGROUND OF THE INVENTION

Self-righting lamp structures commonly are used in highway work zones, construction sites, campsites, and other uses in which it is desirable to have a selectively positionable light source at various locations that are subject to change. Such light fixtures typically comprise an elongated support member having a lamp assembly at its upper end and an enlarged, weighted, generally spherical or rounded self-righting counterweight member or segment at its lower end. Such light fixtures are desirable because they are easy to install in their upright position simply as an incident to placing the light fixture at the desired location. Moreover, if the light fixture is accidentally hit or moved, such as can occur in work zones, the fixture will automatically right itself to the up right position. While ostensibly simple in appearance, construction, and function, such self-righting lamp structures present a number of unexpected problems in their design, manufacture, and usage.

At the outset, the spherical self-righting segment can add considerable weight to the light fixture, making it difficult or awkward to pick-up, handle, or move the light fixture as is frequently necessary during usage. Moreover, excessive counter weighting of the self-righting spherical segment can cause the light fixture to be moved to an upright position with such force it can cause injury to personnel or damage to the light fixture if striking a nearby object. Furthermore, the rounded or spherical bottom of the self-lighting segment can cause the light-fixture to rock excessively and for long periods each time the fixture is repositioned or moved from the upright position. On the other hand, forming a flat bottom on the spherical self-righting segment can cause what is referred to as "slapping", with the flat bottom slamming against a flat floor surface with excessive force each time it is rocked during self-righting positioning. Such self-righting counterweight segments also can make it difficult to orient the light fixture in a particular "non-upright" position for particular lighting applications. While in some instances it may be desirable to position the fixture on its side for downward direction of lighting, the rounded counterweight segment, being designed to upright the light fixture, generally will not permit such side positioning. Likewise, it can be cumbersome to mount or selectively position a reflector about the light assembly of the fixture as is often desired for particular light direction.

Since the elongated support member that extends from the self-righting counterweight segment commonly is a relatively small diameter cylindrical structure, it also can be difficult to mount electrical components, cooling fans, and the like within the support structure of the light fixture as is commonly required. Furthermore, air holes required in the side of the light fixture housing for permitting the circulation of cooling air to the lamp during operation can allow the undesirable entry of rain water, or other contaminates in the surrounding environment, which can hinder proper operation of the electrically operated lamp.

OBJECTS AND SUMMARY OF THE INVENTION

It is an object of the present invention to provide a self-righting light fixture that is optimally counterweighted for reliable uprighting movement without excessive force or rocking of the fixture during repositioning or self-righting of the fixture.

Another object is to provide a self-righting light fixture as characterized above which has a self-righting counterweight segment with a flattened bottom stabilizing surface that quickly stabilizes the light fixture in upright position without excessive slapping or forceful slamming on the floor or mounting surface.

A further object is to provide a self-righting light fixture of the above kind which lends itself to easier handling and moveable positioning in the work areas.

Still another object is to provide a self-righting light fixture of the foregoing type which requires a smaller counter-weight for effecting upright positioning of the light fixture, and hence, which reduces weight and facilitates handling of the fixture.

Still a further object is to provide a self-righting light fixture of such type which lends itself to easier and more economical manufacture and assembly. A related object is to provide such a light fixture which enables easier assembly and mounting of electrical and other internal components of the fixture.

Yet another object is to provide such a self-righting light fixture which has air ventilating apertures that prevent and/or minimize the entry of rain water, moisture, or other contaminates in the working environment.

A further object is to provide such a self-righting light fixture which has a reflector that is adapted for easier selective positioning about the light fixture for directing light in a desired direction.

Other objects and advantages of the invention will become apparent upon reading the following detailed description and upon reference to the drawings, in which:

Figure 1:
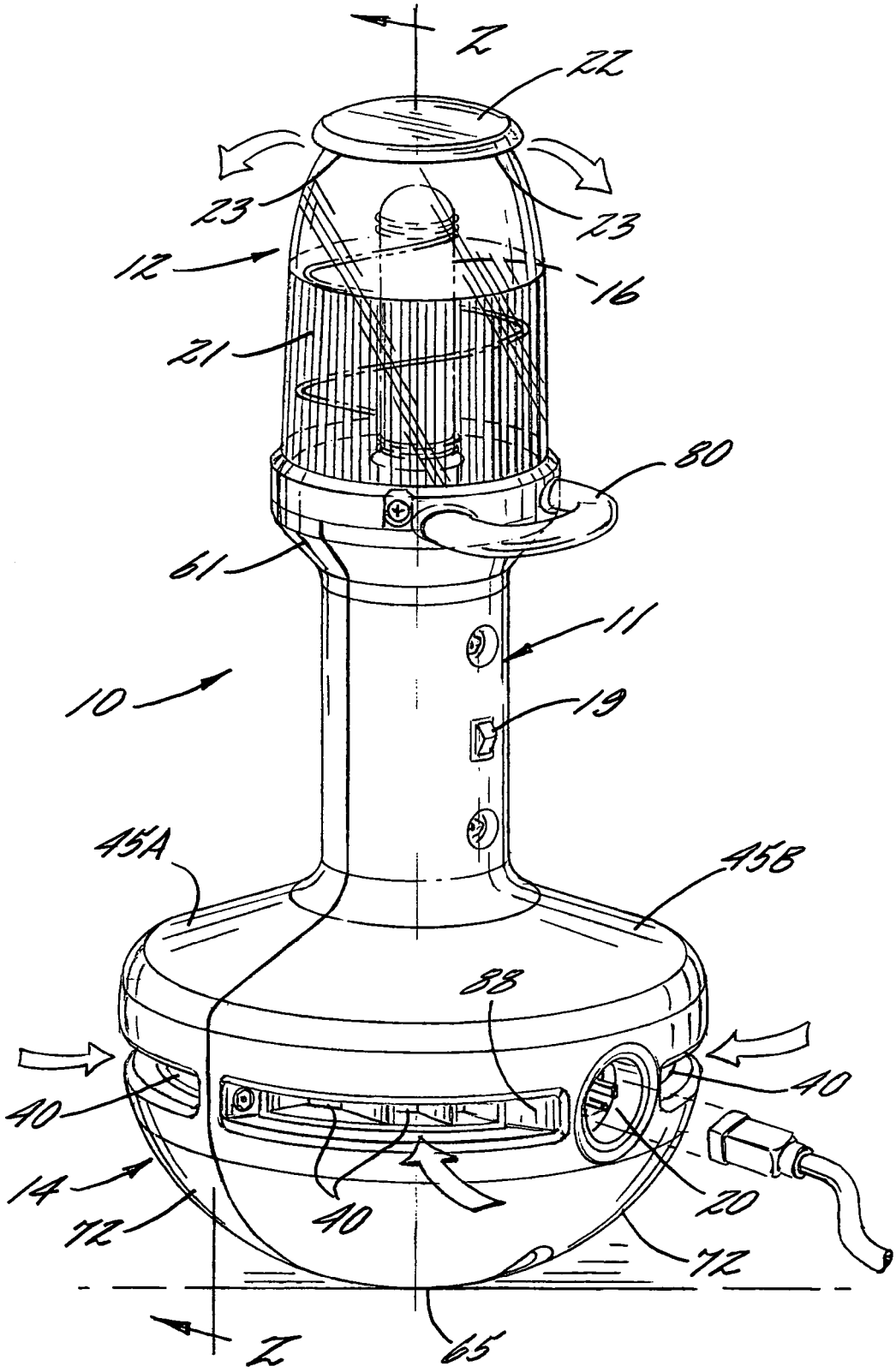
FIG. 1 is a perspective of an illustrative self-positioning light fixture in accordance with the invention.

While the invention is susceptible of various modifications and alternative constructions, a certain illustrated embodiment thereof has been shown in the drawings and will be described below in detail. In should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

Referring now more particularly to the drawings, there is shown an illustrative self-righting light fixture 10 in accordance with the invention which includes an elongated, generally cylindrical support member 11 having a lamp assembly 12 at an upper end and an enlarged diameter, generally rounded, self-righting segment 14 at a bottom thereof. The lamp assembly 12, which may be of a conventional type, in this case is a halogen lamp having a socket 15 and upstanding halogen bulb 16. An electrical cord 18 extends from the lamp socket 15 to a switch 19 mounted in the support member 11, which in turn, is electrically connected to an electrical inlet 20 in a side of the self-righting segment 14.

For diffusing light from the bulb 16, a dome 21 is mounted in surrounding relation to the bulb 16. The dome 21 has a top cover 22 which preferably is adapted for snap action engagement with the dome 21 and which defines air vent apertures 23 about an upper parameter of the dome 21. A spiral configured spring 24 is mounted about the bulb 16 for preventing contact of the bulb 16 with the dome 21 during movement of the light fixture. It will be understood that in lieu of a halogen lamp assembly, other types of lamp assemblies could be used, such as fluorescent and metal halide lamps.

Figure 7:
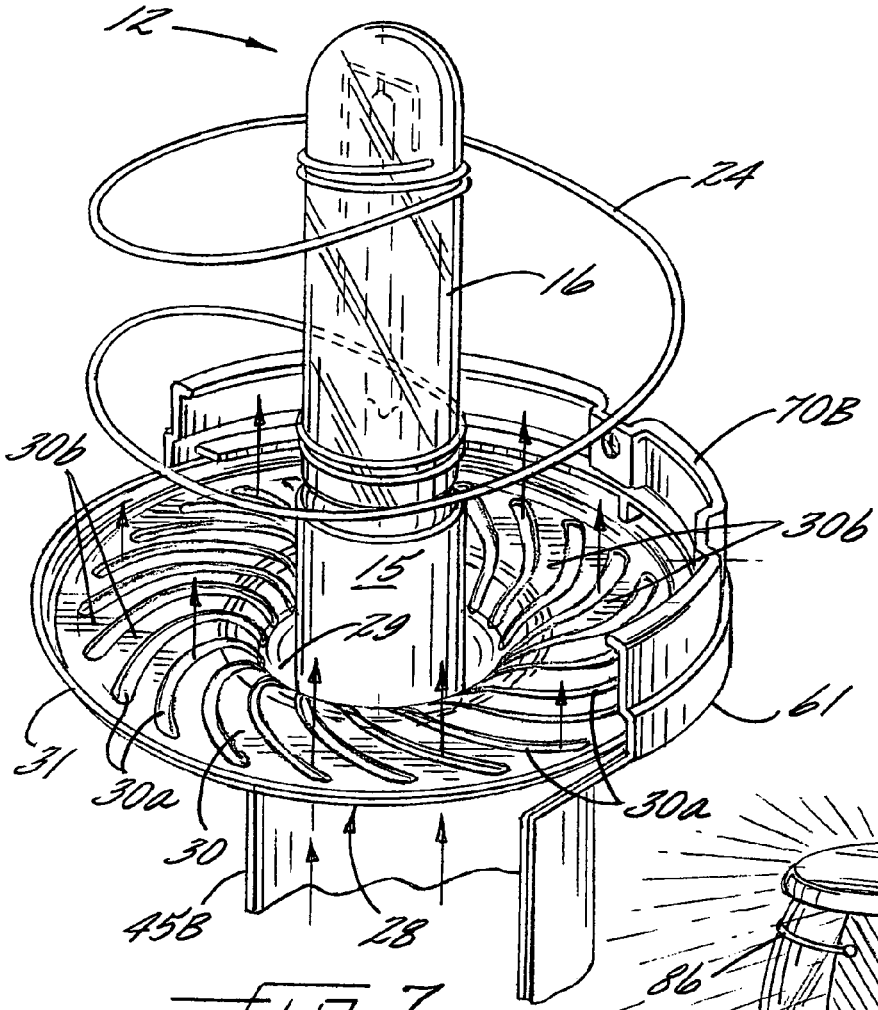
FIG. 7 is an enlarged fragmentary perspective of the lamp assembly and its shock absorbing mounting in the illustrated light fixture.
Figure 8:
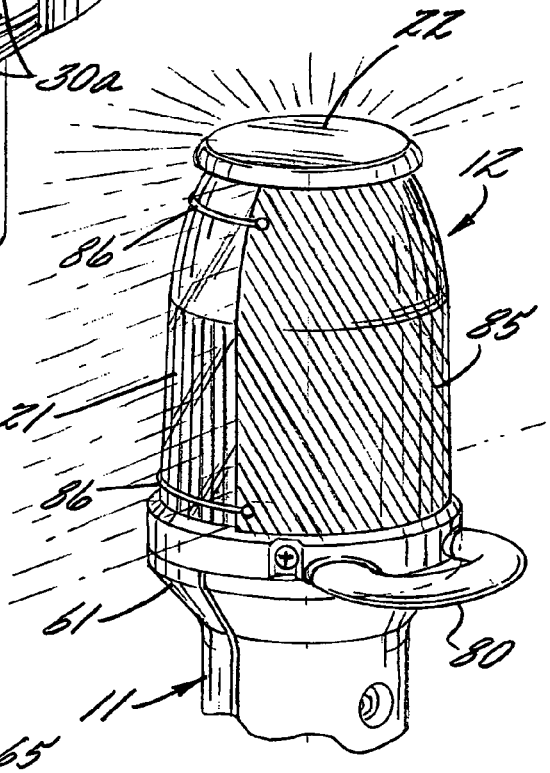
FIG. 8 is a fragmentary perspective showing the lamp dome of the illustrated light fixture with an associated light reflector mounted thereon.

For protecting the socket 15 and lamp bulb 16 from shock forces upon impact or rocking movement of the light fixture 10, the socket 15 is supported in a shock absorbing mounting which permits both longitudinal and lateral movement of the socket 15 with respect to the lamp support structure. The shock absorbing mounting in this case comprises a shock disc 28, preferably molded of a plastic material such as polycarbonyte, that includes a central recessed socket receiving portion 29 in which the socket 15 is affixed, such as by screws, and a radial support portion 30 extending upwardly and outwardly by the socket receiving portion 30 with an intermediate curved bend and having an outer annular mounting flange 31. The radial support portion 30 is formed with a plurality of spirally configured apertures 30*a* which define a plurality of radial support arms 30*b* for resiliently supporting the central socket receiving portion 29. (FIG. 7).

Figure 6:
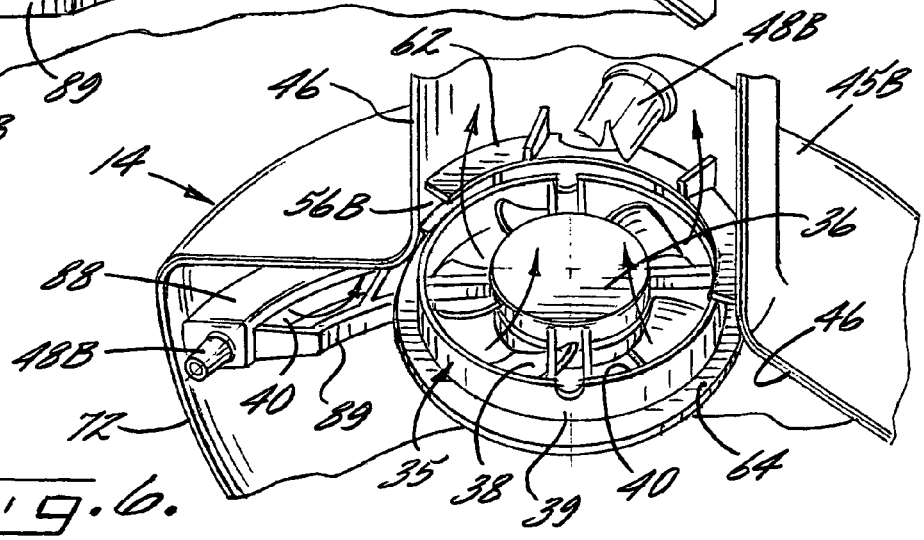
FIG. 6 is an enlarged fragmentary perspective showing the air circulating fan in mounted position in one of the body portions of the illustrated light fixture.

For dissipating heat from the light bulb 16 during operation of the light fixture, a fan 35 is mounted within the elongated support member 11, which also is electrically connected to the electrical inlet 20. The fan 35 in this case has a cartridge construction comprising a central annular motor 36, radially extending fan blades 38, and an outer annular support structure 39 with radial ribs for defining an air flow opening 40 through the fan (FIG. 6). To permit the entry of cooling air from the surrounding environment into and through the support member 11 for direction to the lamp assembly 12 by the fan 35, ventilating opening 40 are provided in the self-righting segment 14.

In accordance with one aspect of the invention, the elongated support member and self-righting segment have a plastic body construction comprising a pair of elongated mateable body portions which can be economically manufactured and easily assembled along an axial parting plane through the support member and self-righting segment and which upon assembly captively retain and support internal components of the light fixture. To this end, in the illustrated embodiment, the light fixture 10 has a plastic body comprising two elongated body portions 45A, 45B separated in a vertical, axial parting plane 46. The body portions 45A, 45B, which may be plastic injection molded, each define a respective half of the elongated lamp support member 11 and self-righting segment 14. To facilitate securement of the body portions 45A, 45B, the body portions are formed with a plurality of integrally formed, inwardly extending protrusions 48A, 48B each adapted for receiving fasteners, in this case screws 50 and nuts 51, for securing the body portions in assembled relation along the vertical parting plane 46. It will be understood that alternatively other means may be provided for securing the body portions 45A, 45B together, such as snap action latches integrally formed on the body portions.

Figure 5:
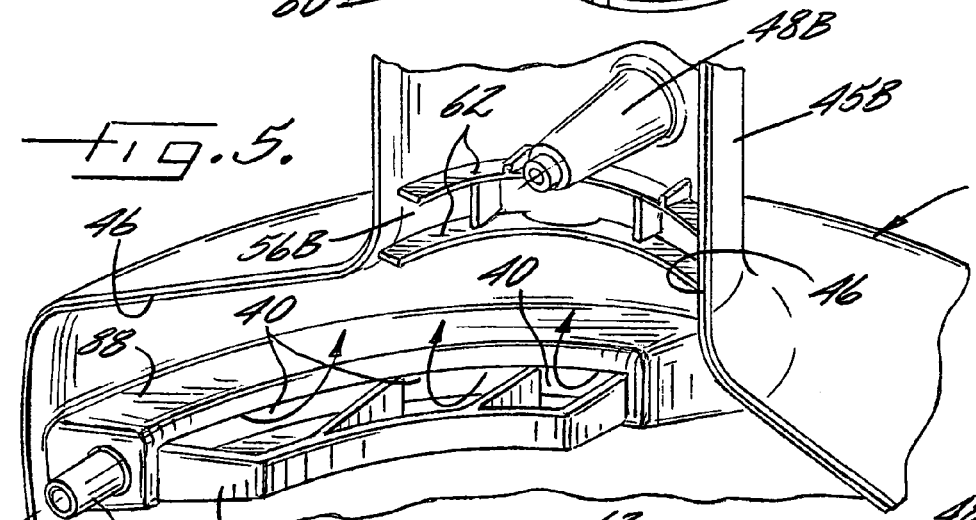
FIG. 5 is an enlarged fragmentary perspective showing the ventilating openings of the illustrated light fixture.

In carrying out the invention, the body portions are formed with internal complimentary pockets adapted for receiving and captively retaining internal components of the light fixture as an incident to assembly and securement of the body portions together along their vertical parting plane. In the illustrated embodiment, the body portions 45A, 45B are formed with respective complimentary upper pockets 55A, 55B for receiving and captively retaining the lamp assembly 12, intermediate pockets 56A, 56B for receiving and supporting the fan 35, and bottom pockets 58A, 58B for receiving and retaining a counter-weight 60 of the self-righting segment 14. The upper pockets 55A, 55B in this case are defined by opposing inwardly facing channels formed in an enlarged diameter lamp mounting, end portion 61 of the elongated support member 11, which are adapted to receive and retain opposite sides of the annular mounting flange 31 of the lamp assembly shock disc 28. The intermediate pockets 56A, 56B are defined by opposing pairs of axially spaced flanges 62 adjacent a lower end of the elongated support member 11, which are adapted for receiving and supporting opposite sides of an outwardly extending radial flange 64 of the fan support structure 39. (FIGS. 5 and 6).

The counterweight receiving pockets 58A, 58B in this case are defined between a bottom wall 65A, 65B of each body portion 45A, 45B and a radial wall defined by the underside wall of a semicircular ribbed reinforcement structure 66A, 66B in the body portion 45A, 45B. The counterweight 60 in this case comprises a pair of semicircular counterweight segments 60A, 60B, each having opposed ends supported within a respective pocket 58A, 58B of the body portions 45A, 45B. The fastener receiving protrusions 48A, 48B in the bottom of the body portions 45A, 45B in this instance extend in a butting relation to each other between the counterweight segments 60A, 60B. It will be appreciated by one skilled in the art that by virtue of such design the light fixture is adapted for relatively quick, easy, and reliable assembly, requiring only that the light assembly 12, fan 35, and counterweight segments 60A, 60B be positioned in the respective pockets of the body portions 45A, 45B, which are thereupon secured together by the fasteners 50,51. The lamp dome 21 also can be easily assembled by positioning about upwardly extending annular flanges 70A, 70B of the assembled body portions 45A, 45B and secured in place, such as by screws.

In accordance with a further aspect of the invention, the self-righting segment of the light fixture is designed for optimally uprighting the light fixture from tipped positions with minimum counter-weighing and without excessive force or rocking movement of the fixture. The illustrated self-righting segment 14 has a central flat bottom stabilizing surface 65 defined by the flat bottom walls 65A, 65B of the body portions 45A, 45B and curved sides 72 extending upwardly and outwardly from the stabilizing surface 65. The curved sides have a maximum diameter D defined by the maximum width of the self-righting segment and a minor diameter D1 defined by the diameter of the flattened bottom stabilizing section 65. The curved sides 72 have a maximum pivot point 75 at a location above the maximum diameter D defined by the pivot or support point of the self-righting segment 14 when the light fixture 10 is in its maximum tilted position with the lamp assembly dome 21 in contact with the floor surface.

Figure 2:
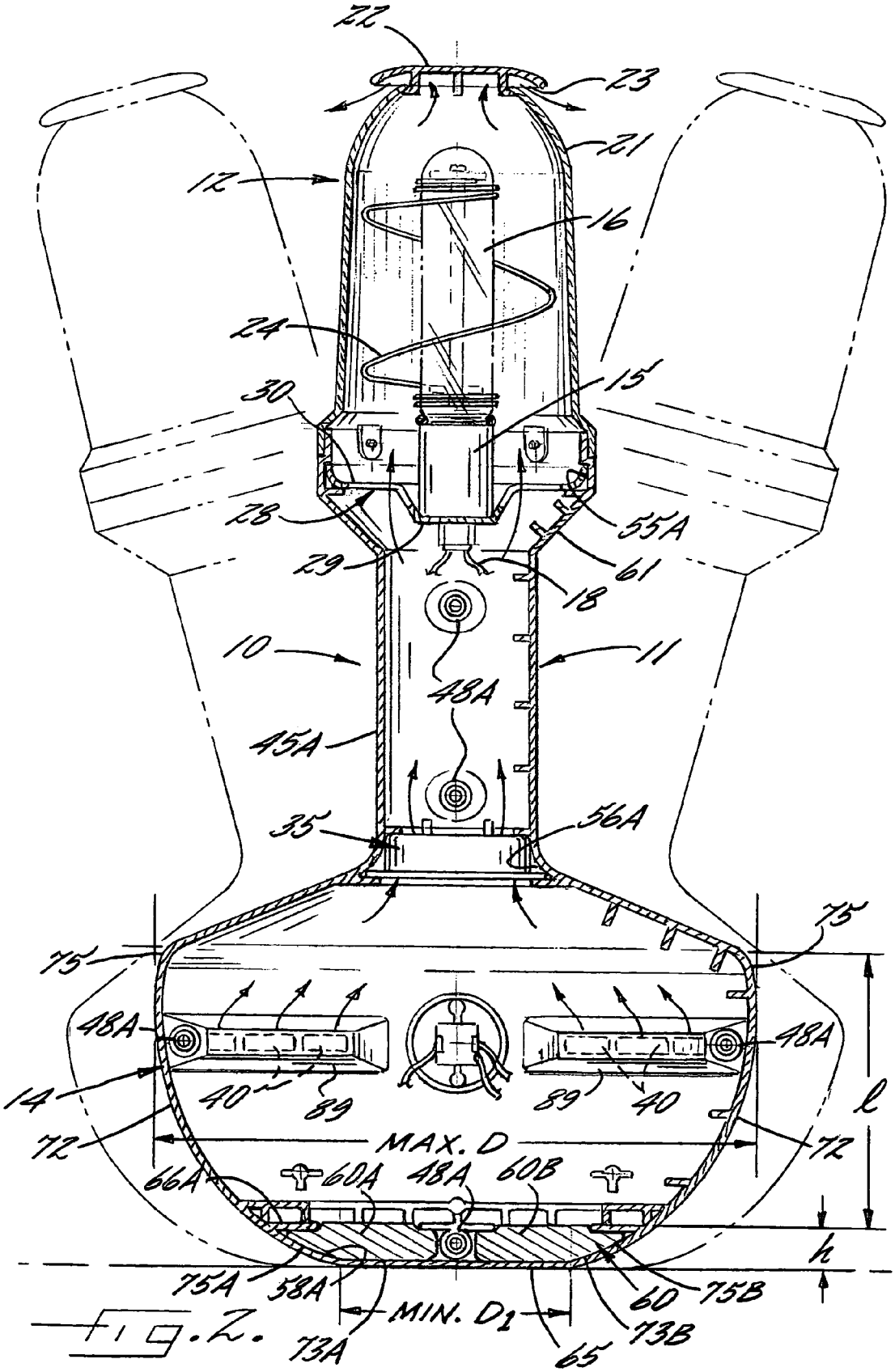
FIG. 2 is a vertical section of the illustrated light fixture taken in the plane of line 2-2 in FIG. 1, showing the light fixture in phantom in opposite moving tilted positions.
Figure 3:
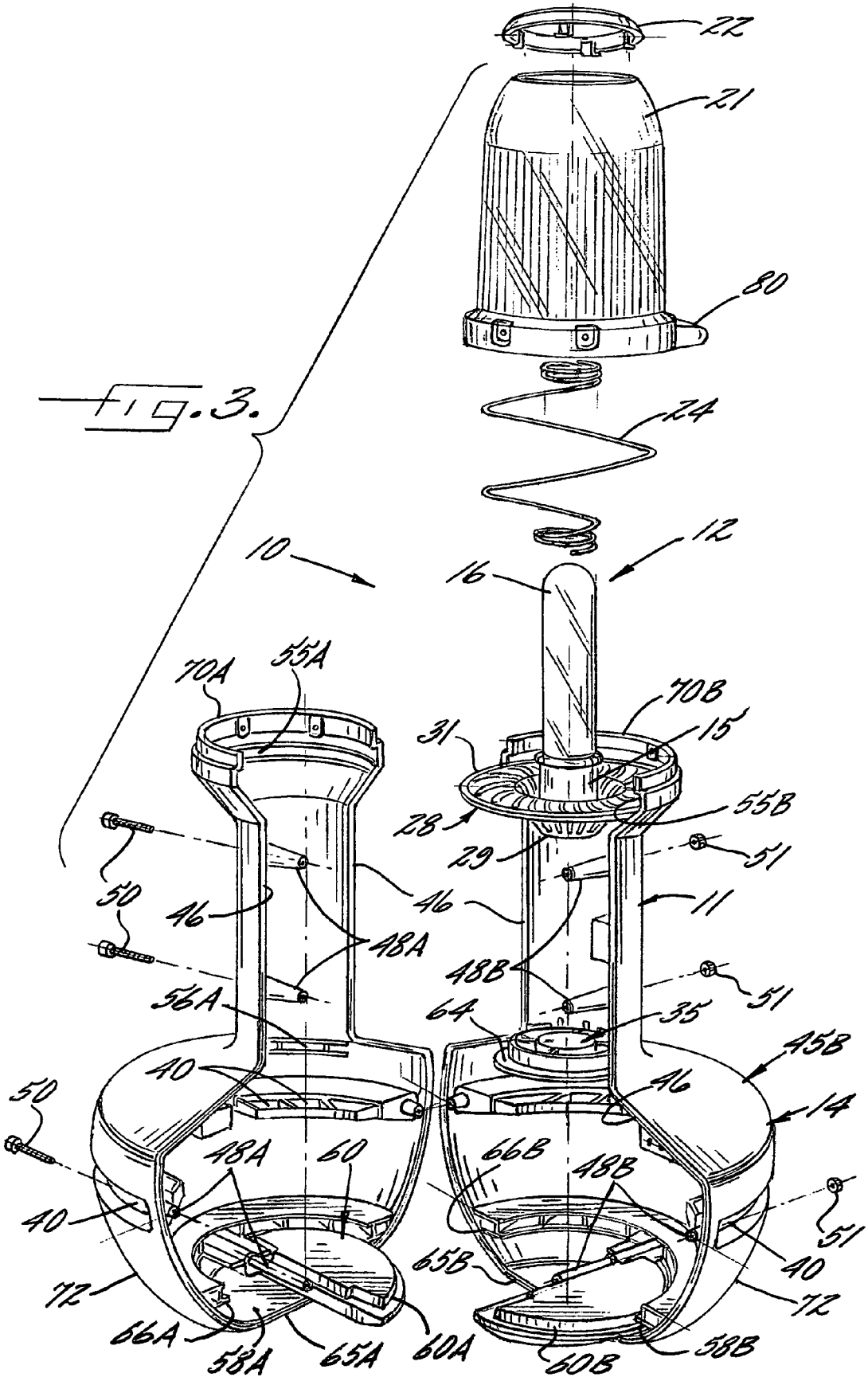
FIG. 3 is an exploded perspective of the illustrated light fixture.
Figure 4:
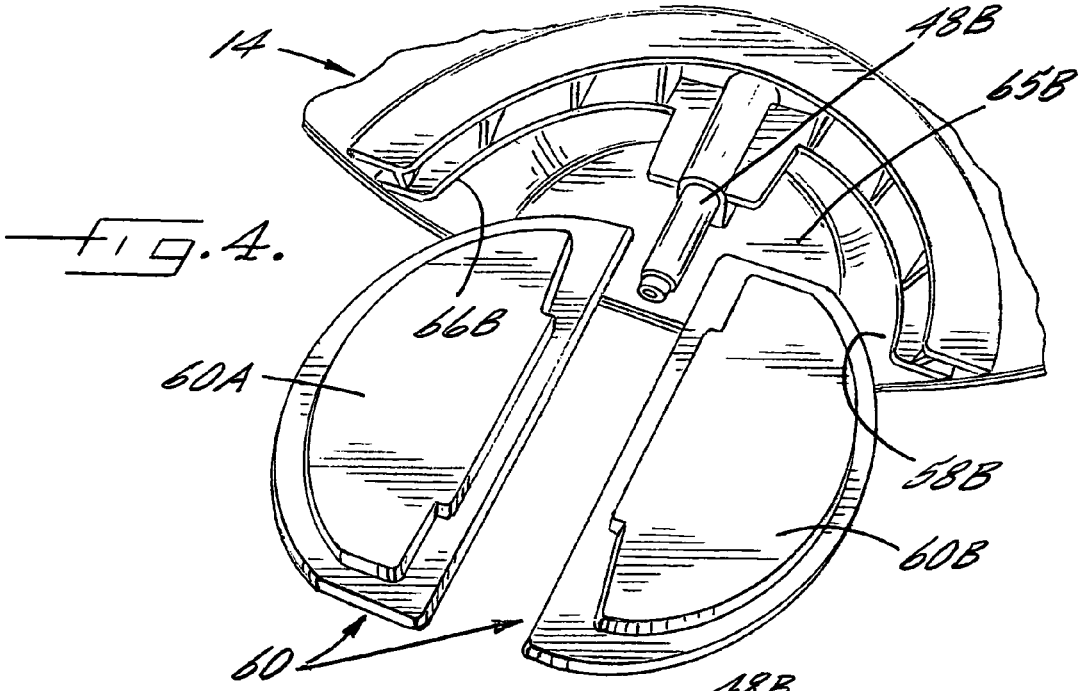
FIG. 4 is an enlarged exploded fragmentary perspective showing the counterweights of the self-righting segment of the light fixture in removed relation to one of the body positions of the illustrated light fixture.

In carrying out the invention, to facilitate minimum counter-weighting of the self-righting segment 14, the counterweight segments 60A, 60B have a relatively flat narrow height construction made of dense material and disposed a distance "l" of at least one third, and preferably between 0.4 and 0.5, the maximum diameter D of the self-righting segment 14 from the maximum pivot point 75 for maximizing the counter-weighting affect. The counterweight segments 60A, 60B preferably are made of metal such as steel, having a density of at least 7.0 g/cm$^3$, and have a height "h" no greater 0.1, and preferably about 0.05, the maximum diameter D of the self-righting segment 14. The counterweight segments 60A, 60B in this case have a flat bottom surface 73A, 73B complimentary to the bottom walls 65A, 65B of the body portions 45A, 45B and sides 75A, 75B that extend outwardly beyond the flat bottom surface 73A, 73B in conformity with the curved sides 72 of the self-righting segment. (FIG. 2) Since the counterweight segments 60A, 60B are located a relatively large distance "l" from the maximum pivot point 75, it has been found that although relatively small in size and weight, reliable counter-weighting can be achieved for uprighting the lamp fixture, even when in its maximum tilted position. Due to optimization of the size and location of the counterweights, the light fixture will return to its upright position without excessive return forces that could injure workers or damage the fixture upon impact without other items in the work zone.

In carrying out the invention, the flat stabilizing surface 65 of the counterweight segment is designed for facilitating self-upright positioning of the lamp fixture without excessive slapping of the flat stabilizing surface on the floor or prolonged rocking. To this end, the flat stabilizing surface 65 has a diameter D1 of between 0.1 to 0.36 the maximum diameter D of the self-righting segment 14, and preferably about ⅓ the maximum diameter of the self-righting segment.

Since the counterweight segments 60A, 60B are relatively small in size and light in weight, compared to counterweights of conventional self-righting light fixtures, it will be appreciated that the reduced weight further facilitates handling of the light fixture. For this purpose, a handle 80 is provided adjacent the top of the elongated support member, which enables easy handling and movement of the light fixture, without requiring the worker to bend over and awkwardly lift or carry the light fixture. The handle 80 in this case is u-shaped and extends in a horizontal plane from the enlarged lamp assembly receiving end portion 61 of the elongated support member 11 for easy access.

Figure 10:
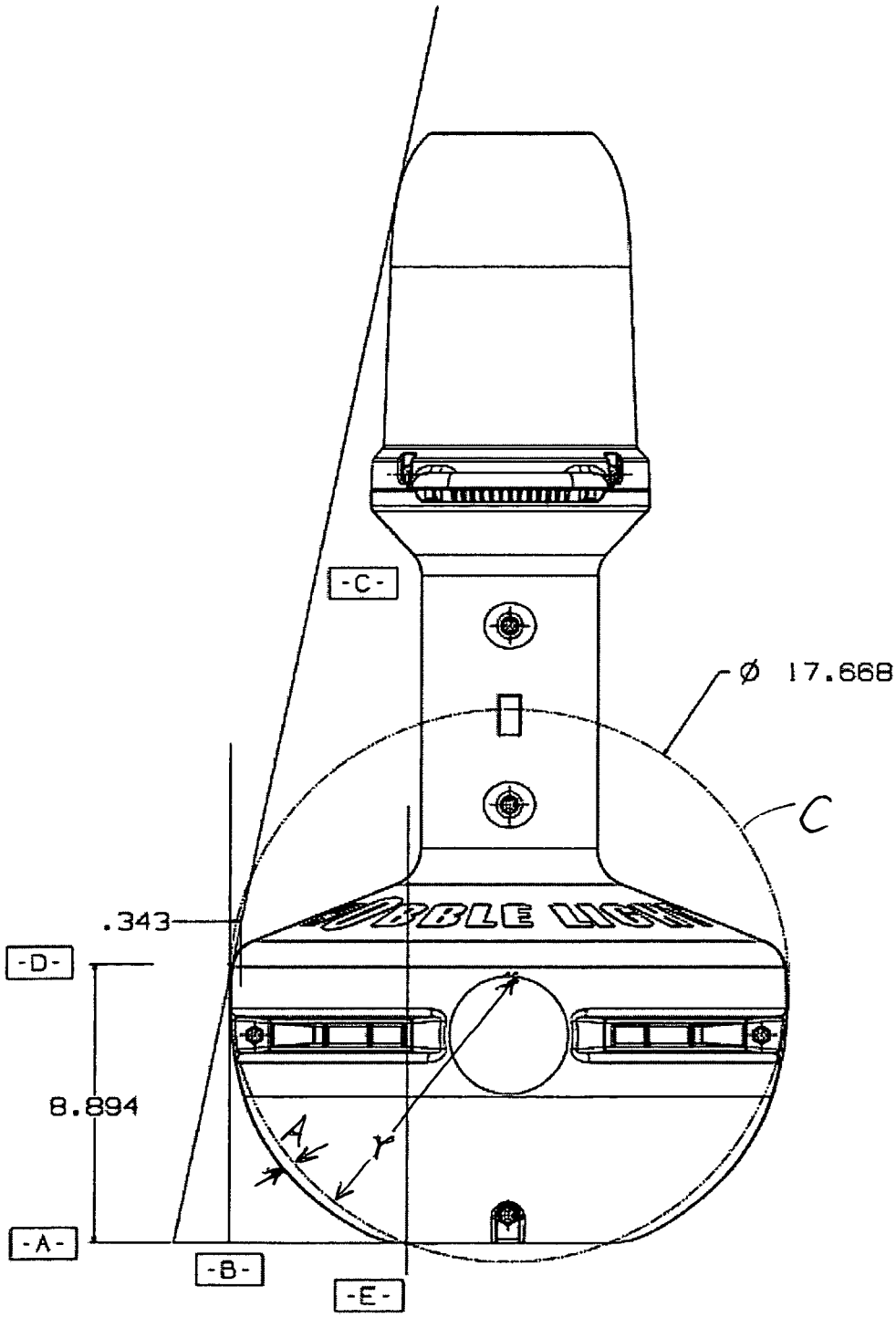
FIG. 10 is a schematic depiction of the lamp assembly showing the rounded wall of the counterweight segment.

In further carrying out the invention, the curved sides of the self-righting segment have a spline curvature that further facilitates reliable pivotal movement of the light fixture between tilted and upright positions with optimal counter-weighting and without hang up or stalling during such movement. In the illustrated embodiment, the rounded wall 72 of the counterweight segment has a curvature extends outwardly beyond a circular curvature defined by a radius "r" centered on the longitudinal axis of the elongated support and counterweight segment that extends through the point of the intersection of the flat stabilizing surface and the curved wall and the point of maximum width of the curved wall 22. As will be appreciated by one skilled in the art, such spline curvature may be designed to ensure relatively constant return movement of the light fixture to an upright position without stalling or hang up as can occur with a circular sidewall design. In this regard, the maximum separation or distance between the curved wall 72 and the referenced circular curvature, such as the distance A illustrated in FIG. 10, is selected to provide such enhanced return movement. The maximum separation preferably is about 5% or less of the radius r of the circular curvature, and more preferably about 2% or less of that radius. In practice the self-righting lamp of the present invention has been found to permit reliable controlled self-righting movement between tilted and upright positions without forceful slapping, excessive rocking, and with minimal counterweight requirements.

While a primary requirement of such self-righting light fixtures is to a automatically returnable to an upright position following tilting upon impact or repositioning, it sometimes is desirable to orient the light fixture in a non-vertical position for particular light direction. Heretofore, it has been difficult to position such light fixtures on their side without manually holding the lamp assembly down, which may be hot and dangerous to handle, or by positioning a weight, such as a piece of construction material or the like over the light fixture, which can be cumbersome and unreliable.

Figure 9:
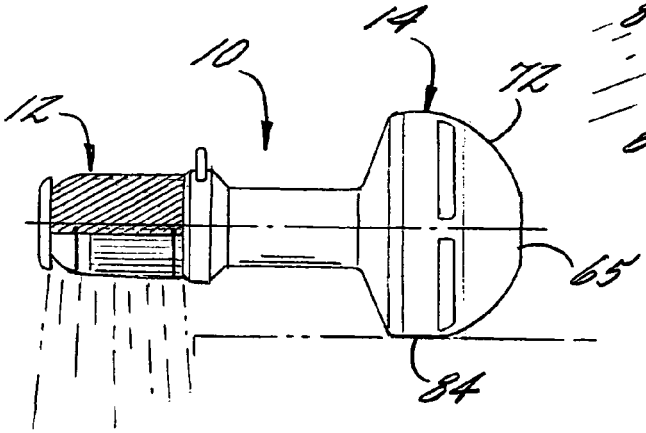
FIG. 9 is a side elevational view of the illustrated lamp fixture shown in a side light directing position.

In keeping with a further aspect of the invention, the self-righting segment 14 is formed with a flat side stabilizing surface 84, in this case having a generally rectangular configuration and sized substantially smaller than the bottom stabilizing surface 65, that permits selective positioning of the light fixture on its side with sufficient stability that it does not self-upright (FIG. 9). When the need for such horizontal light direction ceases to exist, the light fixture may be easily returned to its upright position by simple dislodgement from the side-stabilizing surface 84. The self-righting segment 14 will thereupon return the light fixture 10 to its upright position.

In carrying out still another feature of the invention, a reflector 85 is provided that is adapted for easy selective positioning and mounting about the light assembly dome 21 for specific light direction. The reflector shield 85 preferably comprises a two ply material having an outer non-reflective backing and inner reflective lining made of silver nylon or the like effective for substantially reflecting light generated by the light assembly. For releasably securing the reflector shield 85 on the dome 21, a pair of flexible o-ring bands 86 connect upper and lower sides of the shield together. The bands 86 can be easily stretched over the dome 21 and permit selective positioning of the shield for the particular light direction desired.

Pursuant to a further feature of the invention, the vent openings 40 are formed in the respective body portions 45A, 45B with a design that reinforces the self-righting segment 14 and which prevents or substantially minimizes entry of rain water and/or contaminants from the outside environment into the light fixture during outside usage of the light fixture or in contaminated work areas. In the illustrated embodiment, the vent openings 40 in the self-righting segment 14 communicate with respective annular chambers 88 in the body portions 45A, 45B that extend inwardly into the self-righting segment 14. The annular chambers 88 communicate with further inwardly extending baffle sections 89 having a plurality of tangentially oriented baffles 90 and which open vertically upwardly into the self-righting segment 14. During operation of the fan 35, ventilating air will be drawn into the inlet openings 40, through the annular chambers 88 and through the baffle sections 89 which tangentially and upwardly direct the air into and through the fan opening 40. Since the apertures do not communicate directly or horizontally with the interior of the light fixture, rain or contaminants in the environment are restricted from easy or direct entry into the light fixture. Instead, air is drawn through a circuitous path defined by the inlet openings 40, the internal chamber 88, the baffle section 89 and the vertical openings formed by the baffles 90 therein. The structure that defines air chambers 88 and baffled sections 89 further reinforce the rigidity of the self-righting segment 14.

From the foregoing, it can be seen that the self-righting light fixture of the present invention is optimally counterweighted for reliable uprighting movement without excessive force or rocking of the light fixture during repositioning or self-righting of the fixture. The self-righting counterweight segment of the light fixture further has rounded sides and a flat bottom surface designed for quickly returning the light fixture to an upright position without excessive rocking or forceful slamming onto the floor or mounting surface. The light fixture also is relatively simple in design, relatively light in weight for facilitating handling, and adapted economical manufacture and easy assembly.

The invention claimed is:

1. A self-positioning light fixture comprising:

an elongated body for vertical positioning on a horizontal surface, said elongated body including an upper elongated support and a rounded bottom self-righting segment, said self-righting segment having a larger diameter than said upper elongated support, a bulb receiving lamp socket assembly mounted on an upper end of said elongated support for electrical connection to a power source, said self-righting segment including a counterweight sized to effect self-positioning of the elongated body vertically on said horizontal surface and to return it to said vertical position when tip-tipped away therefrom, said elongated body including a pair of elongated body portions, said elongated body portions each having an elongated lamp support portion and a larger diameter rounded bottom portion, said elongated body portions each defining a vertical parting plane along an elongated side of the lamp support portion and bottom portion thereof, said elongated body portions being releasably mateable relative to each other along said vertical parting planes with said parting planes extending the length of the elongated body axially through the elongated body; and releasable fasteners for securing said body portions together in assembled mated relation along said parting plane.

2. The self-positioning light fixture of claim 1 including at least one light fixture component retained and supported between said elongated lamp support portions of said body portions when said body portions are secured together along said parting plane.

3. The self-positioning light fixture of claim 2 in which said at least one component is partially contained and received within each of said elongated lamp support portions.

4. The self-positioning light fixture of claim 2 in which said elongated lamp support portions are each formed with at least one pocket, and said at least one light fixture component being disposed partially within a pocket of each of said body portions.

5. The self-positioning light fixture of claim 2 in which said at least one component is said bulb receiving lamp socket assembly, said lamp socket assembly having a mounting member with opposed sides supported and retained within said body portions as an incident to securement of the elongated lamp support portions together along said parting plane.

6. The self-positioning light fixture of claim 5 in which said lamp socket assembly mounting member is an annular shock disc adapter for permitting movement of said lamp socket assembly relative to said elongated support upon impact or rocking movement of said elongated support.

7. The self-positioning light fixture of claim 2 in which said at least one light fixture component is a ventilating fan for directing air to said lamp socket assembly, said ventilating fan having opposed sides each supported and retained within said elongated lamp support portions upon securement of the body portions together along said parting plane.

8. The self-positioning light fixture of claim 2 in which said counterweight has opposed sides supported and retained in said body portions upon securement of said body portions together along said parting plane.

9. The self-positioning light fixture of claim 1 in which said self-righting segment has a flat bottom stabilizing surface and a curved side wall extending upwardly and outwardly of said stabilizing surface, said stabilizing surface having a diameter of about ⅓ a maximum width of said curved side wall.

10. The self-positioning light fixture of claim 1 in which said self-righting segment has a flat bottom stabilizing surface and a curved side wall having a non-circular spline configuration.

11. The self-positioning light fixture of claim 1 in which said elongated body portions each have a similar construction.

12. A self-positioning light fixture comprising:

an elongated body for vertical positioning on a horizontal surface, said elongated body including an upper elongated support and a rounded bottom self-righting segment, said self-righting segment having a larger diameter than said upper elongated support, a bulb receiving lamp socket assembly mounted on an upper end of said elongated support for electrical connection to a power source, said self-righting segment including a counterweight sized to effect self-positioning of the elongated body vertically on said horizontal surface and to return it to said vertical position when tip-tipped away therefrom, said elongated body including a pair of body portions each mateable relative to each other along a parting plane through said body, said body portions each having an elongated lamp support portion and a larger diameter rounded bottom portion, releasable fasteners for securing said body portions together in assembled relation along said parting plane; and at least one light fixture component retained and supported between and within the elongated lamp support portions of said body portions upon securement of said body portions together along said parting plane.

13. The self-positioning lamp fixture of claim 12 in which said elongated lamp support portions are each formed with a plurality of pockets, and said light fixture components each being disposed partially within a pocket of each of said body portions.

14. The self-positioning lamp fixture of claim 12 in which said at least one component is said bulb receiving lamp socket assembly.

15. The self-positioning lamp fixture of claim 12 in which said at least one light fixture component is a ventilating fan directing air to said lamp socket assembly.

16. The self-positioning lamp fixture of claim 12 in which said rounded body portions each formed with a respective pocket, and said counterweight is disposed between said rounded bottom portions in the pockets thereof.

17. A self-positioning light fixture comprising:

an elongated body for vertical positioning on a horizontal surface, said elongated body including an upper elongated support and a bottom self-righting segment;

a bulb receiving lamp socket assembly mounted on an upper end of said elongated support for electrical connection to a power source;

said self-righting segment including a counterweight sized to effect self-positioning of the elongated body vertically on said horizontal surface and to return it to said vertical position when tip-tipped away therefrom;

said self-righting segment having a curved side wall to facilitate reliable uprighting movement of said light fixture without hang-up, and said side wall being formed with a flat stabilizing surface for stable positioning of the light fixture on a side without self-uprighting of the elongated body for alternative direction of light from said lamp socket assembly.

18. The self-positioning light fixture of claim 17 in which said self-righting segment has a flat bottom surface for permitting stable vertical positioning on said horizontal support surface, and said side stabilizing surface being in a plane that is at an angle to said bottom stabilizing surface.

19. The self-positioning light fixture of claim 18 in which said side stabilizing surface is in a plane perpendicular to said bottom stabilizing surface.

20. The self-positioning light fixture of claim 19 in which said side-stabilizing surface has a smaller surface area than said bottom stabilizing surface.

21. A self-positioning light fixture comprising:

an elongated body for vertical positioning on a horizontal surface, said elongated body including an upper elongated support and a bottom self-righting segment, said elongated support and said bottom self-righting segment being centered on a longitudinal axis of said elongated body;

a bulb receiving lamp socket assembly mounted on an upper end of said elongated support for electrical connection to a power source;

said self-righting segment including a counterweight sized to effect self-positioning of the elongated body vertically on said horizontal surface and to return it to said vertical position when tip-tipped away therefrom;

said self-righting segment having a flat bottom that defines a flat stabilizing surface and a curved side wall extending upwardly and outwardly from the flat bottom with a point of maximum width of said side wall being disposed above said flat bottom;

said curved side wall having a curvature that extends outwardly beyond a theoretical circular curvature defined by a radius "r" centered on the longitudinal axis of the elongated support and counterweight segment and extending through a point of intersection of the flat stabilizing surface and said curved side wall at a point of maximum width of the curved side wall, and said curved side wall extending outwardly in separated relation to said theoretical circular curvature by an amount of between about 2 and 5% of the radius of the theoretical circular curvature.

* * * * *